US007267761B2

(12) United States Patent
Balko

(10) Patent No.: US 7,267,761 B2
(45) Date of Patent: Sep. 11, 2007

(54) METHOD OF REDUCING SULFUR IN HYDROCARBON FEEDSTOCK USING A MEMBRANE SEPARATION ZONE

(75) Inventor: Jeffrey William Balko, Annapolis, MD (US)

(73) Assignee: W.R. Grace & Co.-Conn., Columbia, MD (US)

( * ) Notice: Subject to any disclaimer, the term of this patent is extended or adjusted under 35 U.S.C. 154(b) by 493 days.

(21) Appl. No.: 10/671,807

(22) Filed: Sep. 26, 2003

(65) Prior Publication Data

US 2005/0067323 A1 Mar. 31, 2005

(51) Int. Cl.
*C10G 17/00* (2006.01)
*C10G 45/00* (2006.01)

(52) U.S. Cl. ..... 208/208 R; 208/211; 585/818; 585/819

(58) Field of Classification Search ..... 208/208 R, 208/211; 585/818, 819; 201/649, 650
See application file for complete search history.

(56) References Cited

U.S. PATENT DOCUMENTS

| | | | | |
|---|---|---|---|---|
| 4,230,463 | A | 10/1980 | Henis et al. | 55/16 |
| 4,243,701 | A | 1/1981 | Riley et al. | 427/244 |
| 4,493,714 | A | 1/1985 | Ueda et al. | 55/16 |
| 4,532,029 | A | 7/1985 | Black et al. | |
| 4,692,271 | A | 9/1987 | Messenger et al. | 252/354 |
| 4,761,229 | A | 8/1988 | Thompson et al. | 210/321.82 |
| 4,781,733 | A | 11/1988 | Babcock et al. | 55/16 |
| 4,921,611 | A | 5/1990 | Schucker | |
| 4,962,271 | A | 10/1990 | Black et al. | 585/819 |
| 4,978,439 | A | 12/1990 | Carnell et al. | 208/91 |
| 5,082,987 | A | 1/1992 | Olbrich et al. | 585/737 |
| 5,104,532 | A | 4/1992 | Thompson et al. | 210/224 |
| 5,169,530 | A | 12/1992 | Schucker et al. | 210/321.81 |
| 5,198,002 | A | 3/1993 | Mei et al. | 55/77 |
| 5,238,563 | A | 8/1993 | Smith, Jr. et al. | 210/321.74 |
| 5,265,734 | A | 11/1993 | Linder et al. | 210/654 |
| 5,286,280 | A | 2/1994 | Chiou | 95/45 |
| 5,306,476 | A | 4/1994 | Jalan | 423/220 |

(Continued)

FOREIGN PATENT DOCUMENTS

GB 2 268 186 A 1/1994

OTHER PUBLICATIONS

Hydrotreating, Refinng 2000, Hydrocarbon Processing, Nov. 2000, pp. 123.

(Continued)

*Primary Examiner*—Tam M. Nguyen
(74) *Attorney, Agent, or Firm*—Charles A. Cross; Beverly J. Artale

(57) ABSTRACT

A membrane is used in combination with fractionation and hydrodesulfurization to reduce the sulfur content of hydrocarbon feeds, preferably sulfur-containing naphtha feeds. A membrane separation zone is employed to treat a fraction of effluent from a fractionation zone containing sulfur-containing non-aromatic hydrocarbons to produce a sulfur rich permeate and sulfur deficient retentate. The sulfur rich permeate and a second fraction of the fractionation zone, which contains sulfur-containing aromatic hydrocarbons, are further treated in a hydrodesulfurization zone. The stream from the hydrodesulfurization zone and the sulfur deficient retentate from the membrane separation zone are then processed as low sulfur hydrocarbon streams, especially those streams being processed in the manufacture of gasoline when the initial hydrocarbon stream is naphtha from a fluidized catalytic cracking unit.

25 Claims, 4 Drawing Sheets

U.S. PATENT DOCUMENTS

| | | | | |
|---|---|---|---|---|
| 5,409,599 | A | 4/1995 | Harandi | 208/210 |
| 5,476,978 | A | 12/1995 | Smith, Jr. et al. | 585/323 |
| 5,510,265 | A | 4/1996 | Monticello | 435/282 |
| 5,525,235 | A | 6/1996 | Chen et al. | 210/641 |
| 5,556,449 | A | 9/1996 | Baker et al. | 95/49 |
| 5,643,442 | A | 7/1997 | Sweet et al. | 208/302 |
| 5,733,663 | A | 3/1998 | Scheunemann et al. | 428/447 |
| 6,024,880 | A | 2/2000 | Ciora et al. | 210/653 |
| 6,180,008 | B1 | 1/2001 | White | 210/500.39 |
| 6,187,987 | B1 | 2/2001 | Chin et al. | 585/819 |
| 6,649,061 | B2 * | 11/2003 | Minhas et al. | 210/640 |
| 6,896,796 | B2 * | 5/2005 | White et al. | 208/208 R |
| 6,946,068 | B2 * | 9/2005 | Groten | 208/213 |
| 2002/0153284 | A1 | 10/2002 | White et al. | 208/209 |

OTHER PUBLICATIONS

Hydrogenation, Refining 2000, Hydrocarbon Processing, Nov. 2000, p. 122.

Gasoline Desulfurization, Refining 2000, Hydrocarbon Processing, Nov. 2000, p. 113.

Tier 2/Sulfur Draft Regulatory Impact Analysis—Apr. 1999, Chapter IV: Technological Feasibility, pp. IV-37 through IV42.

Canadian Chemical News Jul./Aug 1999, Catalytic Distillation, by Flora T.T. Ng, MCIC and Garry L. Rempel, FCIC, FRSC, pp. 19-20.

Novel S-Brane Technology for Improved Ultra-Low Sulphur Gasoline Economics, Prepared for Presentation at the ERTC Annual Meeting, Paris France, Nov. 2002, by J. Balko, N. Wynn, and G. Bourdillon.

* cited by examiner

METHOD OF REDUCING SULFUR IN HYDROCARBON FEEDSTOCK USING A MEMBRANE SEPARATION ZONE

FIELD OF THE INVENTION

This invention relates to methods of reducing sulfur content in sulfur-containing hydrocarbon feedstock, and more particularly, relates to methods that employ membranes.

BACKGROUND OF THE INVENTION

Environmental concerns have led to decreases in the permissible levels of sulfur in hydrocarbon fuels. Sulfur in refinery streams, e.g., feedstocks, is present in a number of different forms, including aliphatic and aromatic compounds. Sulfur, however, tends to be concentrated in the higher boiling fractions, mainly in the form of aromatic heterocycle compounds such as benzothiophenes, and dibenzothiophenes Refiners have employed catalytic hydrodesulfurization processes to reduce sulfur in hydrocarbon fuel feedstock. Conventional hydrodesulfurization processes are capable of removing sulfur compounds, especially the lower molecular weight materials including mercaptan sulfur-containing aliphatic materials and thiophenes to levels of <30 ppm. Hydrodesulfurization processes can also reduce the more refractory sulfur compounds, but only at higher desulfurization severities, increased cost and with greater difficulty.

Petroleum refiners are now in the process of devising methods for making ultra low sulfur gasoline in order to comply with increasingly stringent environmental regulations. In certain countries, regulations require refiners to produce gasoline containing 50-ppm sulfur or less by 2005, and in some countries refiners may have to produce gasoline containing less that 10-ppm sulfur beginning in 2008. Some countries have already introduced tax-incentives for 10-ppm gasoline sulfur levels. Regulations requiring these ultra low sulfur levels will incur great expense in terms of capital expenditures and increased refinery operating costs if the refiner relies on current hydrodesulfurization technology.

Refiners are considering several factors when designing new processes and facilities for meeting these new regulations. Those factors include the required level of sulfur reduction, existing refinery equipment that might be retrofitted/used, overall cost, operational flexibility, simplicity of reconstructing the plant for possible lower sulfur specifications in the future and commercial operating experience of the technology to be used.

Many refiners, particularly those with FCC units producing gasoline having high sulfur levels, have already made strategy and investment decisions for 50-ppm sulfur gasoline. One process being considered by refiners with FCC units is CDTECH, Inc.'s two-zone unit comprising a CDHydro unit and a CDHDS unit. In particular, CDHydro and CDHDS are used to selectively reduce sulfur in naphtha feedstock leaving a fluidized catalyst cracking (FCC) unit with minimum octane loss which is typically seen when employing other catalytic hydrodesulfurization processes to reduce sulfur content. The CDTECH process treats light, mid and heavy cat naphthas (LCN, MCN, HCN), with each fraction treated under optimal sulfur reduction conditions.

The overall CDTECH process begins in the CDHydro unit wherein the FCC naphtha is subject to catalytic distillation. The CDHydro is designed to fractionate the naptha into a low sulfur, low boiling point fraction and a higher sulfur content, higher boiling point fraction. More specifically, catalyst is provided in the CDHydro unit to catalyze the reaction of sulfur-containing aliphatics, e.g., mercaptans, with excess diolefins to produce heavier thioether compounds that will not fractionate with the lighter boiling olefin overhead. The remaining diolefins are partially saturated to olefins by reaction with hydrogen, which is also present in the first zone. The conditions of the CDHydro unit are set at endpoints of about 70° C. so that higher boiling point sulfur species, such as thiophenes and benzothiophenes, in the FCC naptha will not fractionate as part of the lighter boiling point overhead. These species, along with the thioethers, will be present in the CDHydro high boiling bottoms product.

Bottoms from the CDHydro column are then fed to a second zone, i.e., a CDHDS column, where the bottoms are catalytically desulfurized in the presence of hydrogen. The hydrodesulfurization conditions are optimized to achieve the desired sulfur reduction with minimal olefin saturation. Olefins are concentrated at the top of the CDHDS column, where conditions are mild, while sulfur is concentrated at the bottom where the conditions result in very high levels of hydrodesulfurization.

The product streams from the two zones are stabilized together or separately, as desired, resulting in product streams appropriate for their subsequent use.

While the CDTECH process has shown to effectively reduce sulfur in naphtha feeds, they do require significant capital investment and relatively high operating costs, with a significant portion of these costs relating to the CDHDS unit and its operation. Furthermore, only 40% of FCC gasoline is passed into CDHydro's overhead, thereby subjecting a significant portion of the FCC gasoline's olefin content to hydrogen and saturation in the CDHDS zone. Accordingly, refiners selecting a CDTECH process to meet the new sulfur regulations are facing significant expenses.

Membrane processes have also been suggested for reducing sulfur content in hydrocarbon feedstocks. Published Patent Application 2002/0153284, published on Oct. 24, 2002, describes employing membranes to reduce sulfur content of a naphtha feedstream from a FCC unit. A membrane is selected so that when the sulfur-containing naphtha is contacted with the membrane, a sulfur rich permeate is created on one side of the membrane while a sulfur deficient retentate is created on the other side of the membrane. The retentate is then processed further as a low sulfur product stream, while the permeate is routed to a traditional sulfur reduction unit. Membrane units, usually in the form of modules, are relatively inexpensive, and are an excellent choice for those refiners who have not yet invested capital in another type of sulfur reduction. Currently available membranes, however, do not remove certain sulfur species, e.g., mercaptans, as effectively as aromatic sulfur species. There may be a benefit of employing other technologies with membranes when faced with removing significant amounts of mercaptans.

For those refiners who have already selected a capital intensive sulfur reduction process, it would be highly desirable to find a way to defray and/or reduce the costs of the process, either by lowering costs to operate the equipment, reducing the wear and tear on the same or reducing the cost of replacement equipment when a piece of equipment has failed. Additionally, it is expected that the requirement to debottleneck the capital intensive sulfur reduction process will create opportunities for new less expensive processes used in concert with the originally selected technologies.

SUMMARY OF THE INVENTION

A process for reducing sulfur content in a sulfur-containing hydrocarbon feedstock has been developed where fractionation and desulfurization zones, e.g., those used in the afore-mentioned CDTECH process, can be operated more efficiently by employing a Membrane Separation Zone.

The process comprises contacting the sulfur-containing hydrocarbon feedstock with the Fractionation Zone to produce at least two sulfur-containing fractions, Fraction (1) and Fraction (2), wherein Fraction (1) has a lower boiling point than Fraction (2). A Membrane Separation Zone is used to further treat Fraction (1). The membrane has a sufficient flux and selectivity to separate a sulfur rich permeate fraction and a sulfur deficient retentate fraction, the relative sulfur content of each fraction being compared to the sulfur content in Fraction (1). The sulfur deficient retentate can be processed as a low sulfur blendstock. The sulfur enriched permeate fraction and Fraction (2) from the Fractionation Zone are contacted with a Desulfurization Zone to reduce the sulfur content of those fractions. These fractions can be introduced to the Desulfurization Zone separately or as a combination. A reduced sulfur-containing hydrocarbon stream is then recovered from the Desulfurization Zone and processed as a low sulfur hydrocarbon stream. It has been found that one can obtain overall sulfur levels of 50-ppm or less using the process, yet also allows for a more overall cost effective operation of the process.

In a preferred embodiment, the Fractionation Zone is a catalytic distillation zone wherein low boiling sulfur-containing species such as mercaptans are catalytically reacted to prevent them from boiling into Fraction (1). The conditions used in the Fractionation Zone of this invention can be adjusted to drive a greater volume of Fraction (1) and other higher boiling sulfur-containing species, e.g., thiophenes or alkylthiophenes, which are then contacted with the membrane, thereby reducing the fraction volume and amount of sulfur species in Fraction (2). The adjusted conditions are also conducive to driving more olefinic species to Fraction (1), which in turn are retained in the sulfur deficient retentate and processed without having to be contacted with the Desulfurization Zone where octane loss can occur through hydrogenation of the olefins.

DETAILED DESCRIPTION

Figure 1:
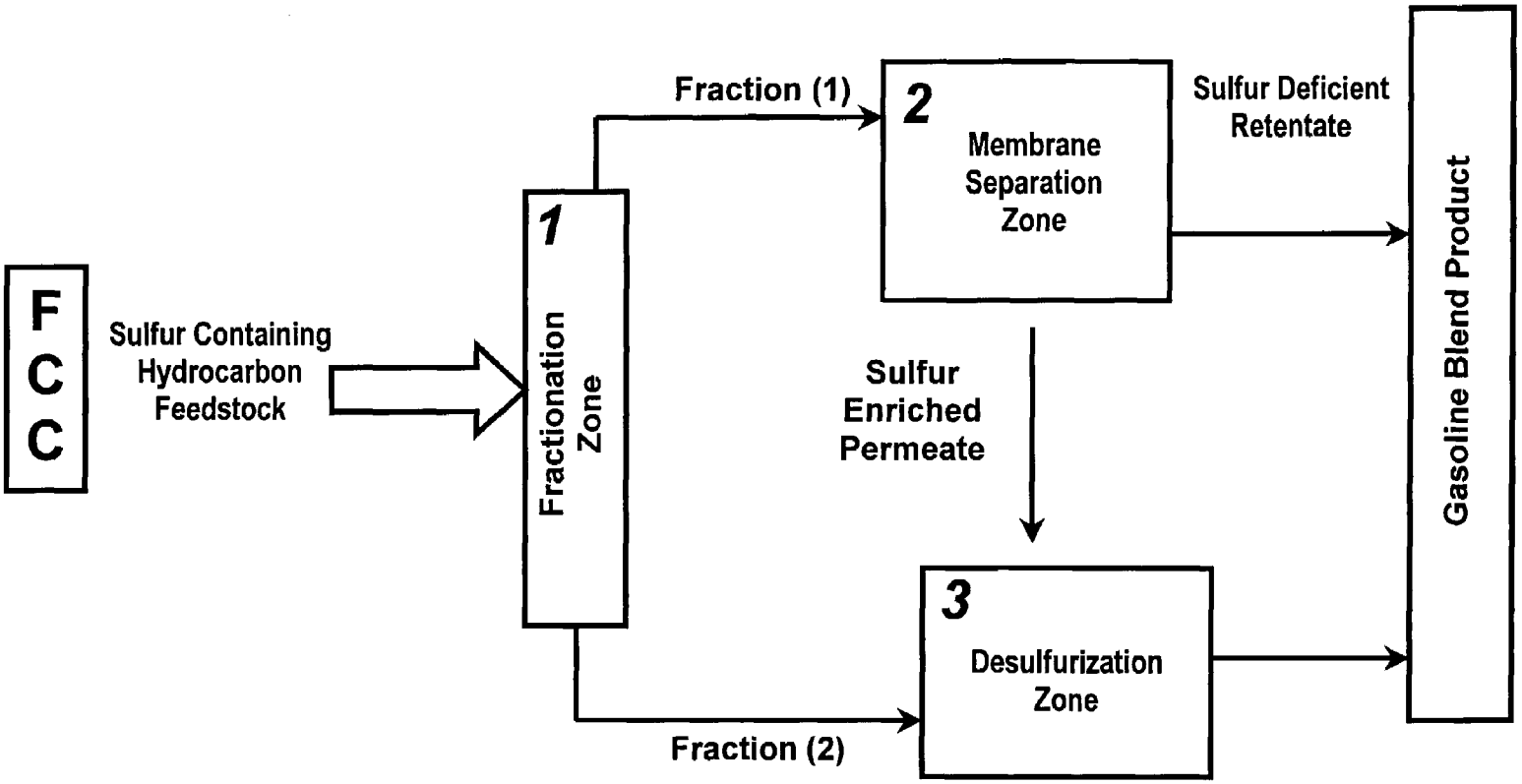
FIG. 1 is a schematic illustration of the invention processing a sulfur-containing naphtha feedstock.

Sulfur-containing hydrocarbon feedstocks that can be treated according to this invention are naphtha streams from a FCC unit. The naphtha feed is in a liquid or substantially liquid form. Sulfur in naphtha and other refinery streams comes in different forms. For the purposes of this invention, the forms are classified as sulfur-containing aromatic hydrocarbons and sulfur-containing non-aromatic hydrocarbons. Preferably, the naphtha is not hydrotreated prior to use in the inventive process. Typically, the hydrocarbon streams will contain greater than 150-ppm, more typically from about 150-ppm to 3000-ppm, and more frequently from about 300 to about 1000-ppm, sulfur. The process of this invention is particularly useful in refining those crudestocks known to have a relatively large amount of these sulfur species. Such crudestocks include heavy sour Canadian, Mexican and Venezuelan crudes.

For purposes of this invention, the term "naphtha" is used herein to indicate hydrocarbon streams found in refinery operations that have a boiling range between about 50° C. to about 220° C. The naphtha fractions contain various amounts of olefinic, aromatic, and non-aromatic, e.g., aliphatic, hydrocarbon compounds and are primarily differentiated by the following boiling ranges. Light naphthas have a boiling point ranging from 50° C. to about 105° C. Middle (mid) naphtha has a boiling point ranging from 105° C. to about 160° C. Heavy cat naphtha has a boiling point ranging from about 160° C. to about 220° C.

The term "aromatic hydrocarbon compounds" is used herein to designate a hydrocarbon-based organic compound containing one or more aromatic rings, e.g. fused and/or bridged. An aromatic ring is typified by benzene having a single aromatic nucleus. Aromatic compounds having more than one aromatic ring include, for example, naphthalene, anthracene, etc. Aromatic hydrocarbons that are typically found in feedstocks to be treated by this invention include those having 1 to 2 aromatic rings. Typical sulfur-containing aromatic hydrocarbons include, but are not limited to, thiophene, alkylthiophenes, benzothiophene and alkylbenzothiophenes.

The term "non-aromatic hydrocarbon" is used herein to designate a hydrocarbon-based organic compound having no aromatic nucleus.

For purposes of this invention, the term "hydrocarbon" is used to mean an organic compound having a predominately hydrocarbon character. It is contemplated within the scope of this definition that a hydrocarbon compound may contain at least one non-hydrocarbon radical (e.g., sulfur or oxygen) provided that said non-hydrocarbon radical does not alter the predominant hydrocarbon nature of the organic compound. Typical sulfur-containing non-aromatic hydrocarbons include, but are not limited to, low molecular C2-C7 aliphatics, e.g., mercaptans compounds, sulfides and thiophenols.

As already discussed, the process of this invention is particularly suitable for reducing sulfur in FCC naphtha but it is also suitable for reducing sulfur in hydrocarbon stocks found in other areas of the refining process, or in areas outside refining.

FIG. 1 illustrates processing a sulfur-containing naphtha feedstock from an FCC unit. The naphtha is contacted with the Fractionation Zone where at least two fractions are created. Fraction (1) has a lower boiling point than Fraction (2). Fraction (1) is contacted with the Membrane Separation Zone 2, and Fraction (2) is transferred and contacted with Desulfurization Zone 3. The Membrane Separation Zone divides Fraction (1) into a sulfur enriched permeate and a sulfur deficient retentate, with the former contacted with Desulfurization Zone 3 and the latter further processed to produce gasoline blend stock. The effluent from Desulfurization Zone (3) is also later processed as a low sulfur gasoline blend stock. Each of the zones and details of their operation follow.

Fraction Zone

As mentioned earlier, sulfur reduction processes that employ a combination of catalytic distillation and catalytic hydrodesulfurization are currently in use and sold by CDTECH Inc. When employing the CDTECH process in the process of this invention it is preferable that the CDHydro process be used as the Fractionation Zone. CDHydro is a catalytic distillation tower that is designed to produce low sulfur overhead product, with that product referred to as overhead because that product is the lighter boiler fraction driven off by the distillation tower.

In one embodiment of the invention all of the FCC naphtha is fed to the CDHydro column. The $C_5$ and $C_6$ petroleum compounds boil off and head up through catalyst mounted in the column, along with hydrogen, which is also injected in the bottom of the column. Naphtha feed that is fed to the CDHydro is preferably not hydrotreated to hydrogen sulfide, and is instead preferably subjected to catalytic treatment, wherein mercaptan-containing compounds in the feed are catalytically reacted with dienes in the naphtha feed to form thioethers. For the purposes of this invention a mercaptans includes compounds R—SH wherein R is a hydrocarbon. Their higher boiling temperature causes the thioethers to fall to the bottom of the column. The thioethers join the heavier petroleum compounds at the bottom of the column and are sent to the CDHDS column. Because the pressure and temperature of the catalytic distillation column is much lower than conventional hydrotreating, saturation of olefins is reduced to very low levels (according to CDTECH, the saturation which does occur is desirable to eliminate diolefins). Thus, little excess hydrogen is consumed. Producing a low sulfur overhead product from the CDHydro in the CDTECH process requires an overhead product endpoint of about 70° C. in order not to drive the higher boiling sulfur-containing aromatic hydrocarbons, e.g. thiophene, into the overhead.

The process of this invention, however, does not require limiting the boiling endpoint to such a low temperature. For most refiners, it is indeed an advantage to drive more FCC gasoline volume into the overhead in order to thus decrease the amount of olefins running through desulfurization, e.g., hydrodesulfurization like CDHDS. Accordingly, the Fractionation Zone of this invention is operated under conditions sufficient to at least drive both olefins and sulfur-containing aromatic hydrocarbons, e.g., thiophene and alkylthiophene, into the overhead product. Accordingly, the Fractionation Zone of this invention can be operated such that the overhead material has a final boiling point of up to 200° C. Pressures in the zone are in the range of 100 to 500 psi. The final boiling point of the overhead depends on a number of factors, including the temperature and pressure profile of the zone as the material travels through the zone, reflux ratio and internal structure of the zone, internal structure including catalyst packing configurations and catalyst trays. These factors can all be adjusted using conventional techniques to produce an overhead having a final boiling point as high as 200° C. For the purpose of this invention, "final boiling point" is that boiling point of the heaviest fraction in the overhead. Catalysts suitable for use in these zones comprise typical hydrotreating catalysts such as NiMo, CoMo supported on aluminas the compositions and manufacture of which are known to those skilled in the art Operating the Fractionation Zone under the above conditions creates at least Fractions (1) and (2) mentioned earlier. Fraction (1) has a lower boiling point than that of Fraction (2). When a CDHydro is used as the Fractionation Zone of the invention, Fraction (1) is substantially free of mercaptans-containing compounds, with thiophenes and/or alkylthiophenes being the predominant sulfur species. Other species such as thiophenols can also be present in Fraction (1). When a conventional fractionation unit (non-reactive and non-catalytic) is used as the Fractionation Zone, Fraction (1) contains mercaptans-containing sulfur species, which can be treated separately as discussed later below.

When using CDHydro with this invention, Fraction (2) also comprises sulfur-containing aromatic hydrocarbons, but those sulfur containing species have higher boiling points and include species such as benzothiophenes and alkylbenzothiophenes as the predominant species. Lower boiling point sulfur-containing aromatic hydrocarbons, such as thiophene, are also present in Fraction (2), but in the process of this invention generally are present in relatively lesser amounts when the Fractionation Zone is run to produce overhead having final boiling points as high as 200° C. As mentioned earlier, running the Fractionation Zone to a higher boiling endpoint drives lower boiling point sulfur-containing hydrocarbons into Fraction (1). Other sulfur species present in Fraction (2) include those known as refractory sulfur compounds. See U.S. Pat. No. 5,409,599. Substituted dibenzothiophenes and other high molecular weight aromatic hydrocarbons are examples of such refractory compounds. Thioether sulfur species produced from the reaction of mercaptans and diolefins are also present in present in Fraction (2).

Fractions (1) and (2) also contain hydrocarbons which do not contain sulfur. Non-sulfur containing compounds include paraffins, olefins, napthenes and cyclic olefins. Of those species, the process of this invention drives more $C_6$, $C_7$, $C_8$ and $C_9$ species into Fraction (1) compared to overhead generated by the CDHydro column of the CDTECH Process. The $C_6$-$C_9$ species are in addition to $C_4$ and $C_5$ typically found in distillation overhead from a CDHydro unit. As a result of the fractionation conditions of this invention there are lesser amounts of $C_6$-$C_9$ species in Fraction (2) compared to the bottoms product of a CDHydro unit run at typical conditions, which in general comprise $C_6$, $C_7$ and $C_8$-$C_{12}$ species.

Operating the Fractionation Zone under the above conditions reduces the volume in the subsequent Desulfurization Zone, which in the CDTECH Process is the capital intensive and costly to operate CDHDS Unit. In certain embodiments of the invention, up to 70% of the initial olefin-containing FCC naphtha feed can be driven into the Fraction (1). Therefore, the process of this invention not only provides a method to reduce olefin loss due to conventional hydrodesulfurization processes, it also increases throughput capacity in the sulfur reduction step relative to the CDHDS of the conventional CDTECH process. These improvements can be achieved with a more modest investment in a Membrane Separation Zone described later below.

The equipment used to operate in the Fractionation Zone can be one or more conventional distillation columns or towers used to fractionate liquid streams containing a mixture of two or more liquids having different boiling points. A CDHydro tower can be used when running a catalytic distillation process is desired. Conventional fractionation towers (which do not have catalyst trays) can also be used. Equipment, which can accommodate boiling endpoints of 70° C. and higher are preferable when processing naphtha streams from an FCC unit.

The equipment, of course, includes means to route feeds to the Membrane Separation Zone and the Desulfurization Zone. The process of this invention can optionally include routing Fraction (2) to a holding tank and/or mixer in order to mix Fraction (2) with sulfur enriched permeate from the Membrane Separation Zone (discussed below) prior to routing the combination to the Desulfurization Zone. Otherwise, Fraction (2) can be routed directly to the Desulfurization Zone through a conduit that is separate from the conduit routing the sulfur enriched permeate from Membrane Separation Zone.

Membrane Separation Zone

When the process of this invention employs a catalytic distillation unit such as the CDHydro unit from CDTECH, Fraction (1) can be routed directly to the Membrane Separation Zone. In other embodiments, e.g., when a nonreactive distillation fractionation is used in the Fractionation Zone, Fraction (1) may optionally be further treated before contacted with the Membrane Separation Zone. For example, if Fraction (1) is overhead from a nonreactive fractionator, Fraction (1) will likely contain mercaptans-containing species in addition to thiophenes due to the relatively lower boiling point of mercaptans and the fact these species are not reacted to form higher molecular weight compounds during fractionation. Accordingly, Fraction (1) can be optionally treated with a mercaptans extraction unit prior to contact with the Membrane Separation Zone.

Membranes useful in the present invention are those membranes having a sufficient flux and selectivity to permeate sulfur-containing compounds in the presence of hydrocarbons containing sulfur and in particular, sulfur-containing naphtha, which also contains olefin unsaturation. The membrane will typically have a sulfur enrichment factor of greater than 1.5, preferably greater than 2, even more preferably from about 2 to about 20, most preferably from about 2.5 to 15. Preferably, the membranes have an asymmetric structure, which may be defined as an entity composed of a dense ultra-thin top "skin" layer over a thicker porous substructure of a same or different material. Typically, the asymmetric membrane is supported on a suitable porous backing or support material.

In one embodiment of the invention, the membrane is a polyimide membrane prepared from a Matrimid® 5218 or a Lenzing polyimide polymer as described in U.S. Pat. No. 6,180,008, incorporated herein by reference.

In another embodiment of the invention, the membrane is one having a siloxane-based polymer as part of the active separation layer. Typically, this separation layer is coated onto a microporous or ultrafiltration support. Examples of membrane structure incorporating polysiloxane functionality are found in U.S. Pat. Nos. 4,781,733, 4,243,701, 4,230,463, 4,493,714, 5,265,734, 5,286,280 and 5,733,663, said references being herein incorporated by reference.

In still another embodiment of the invention, the membrane is an aromatic polyurea/urethane membrane as disclosed in U.S. Pat. No. 4,962,271, herein incorporated by reference, which polyurea/urethane membranes are characterized as possessing a urea index of at least 20% but less than 100%, an aromatic carbon content of at least 15 mole %, a functional group density of at least about 10 per 1000 grams of polymer, and a C=O/NH ratio of less than about 8.

The membranes can be used in any convenient form such as sheets, tubes or hollow fibers. Sheets can be used to fabricate spiral wound modules familiar to those skilled in the art. Alternatively, sheets can be used to fabricate a flat stack permeator comprising a multitude of membrane layers alternately separated by feed-retentate spacers and permeate spacers. This device is described in U.S. Pat. No. 5,104,532, herein incorporated by reference.

Tubes can be used in the form of multi-leaf modules wherein each tube is flattened and placed in parallel with other flattened tubes. Internally each tube contains a spacer. Adjacent pairs of flattened tubes are separated by layers of spacer material. The flattened tubes with positioned spacer material are fitted into a pressure resistant housing equipped with fluid entrance and exit means. The ends of the tubes are clamped to create separate interior and exterior zones relative to the tubes in the housing. Apparatus of this type is described and claimed in U.S. Pat. No. 4,761,229, herein incorporated by reference.

Hollow fibers can be employed in bundled arrays potted at either end to form tube sheets and fitted into a pressure vessel thereby isolating the insides of the tubes from the outsides of the tubes. Apparatus of this type are known in the art. A modification of the standard design involves dividing the hollow fiber bundle into separate zones by use of baffles, which redirect fluid flow on the tube side of the bundle and prevent fluid channeling and polarization on the tube side. This modification is disclosed in U.S. Pat. No. 5,169,530, herein incorporated by reference.

Multiple separation elements, be they spirally wound, plate and frame, or hollow fiber elements can be employed either in series or in parallel. U.S. Pat. No. 5,238,563, herein incorporated by reference, discloses a multiple-element housing wherein the elements are grouped in parallel with a feed/retentate zone defined by a space enclosed by two tube sheets arranged at the same end of the element.

The Membrane Separation Zone employs selective membrane separation conducted under pervaporation or perstraction conditions. Preferably, the process is conducted under pervaporation conditions.

The pervaporation process relies on vacuum or sweep gas on the permeate side to evaporate or otherwise remove the permeate from the surface to the membrane. The feed is in the liquid and/or gas state. When in the gas state the process can be described as vapor permeation. Pervaporation can be performed at a temperature of from about 25° C. to 200° C. and higher, the maximum temperature being that temperature at which the membrane is physically damaged. It is preferred that the pervaporation process be operated as a single stage operation to reduce capital costs.

The pervaporation process also generally relies on vacuum on the permeate side to evaporate the permeate from the surface of the membrane and maintain the concentration gradient driving force which drives the separation process. The maximum temperature employed in pervaporation will be that necessary to vaporize the components in the feed which one desires to selectively permeate through the membrane while still being below the temperature at which the membrane is physically damaged. Alternatively to a vacuum, a sweep gas can be used on the permeate side to remove the product. In this mode the permeate side would be at atmospheric pressure.

In a perstraction process, the permeate molecules in the feed diffuse into the membrane film, migrate through the film and reemerge on the permeate side under the influence of a concentration gradient. A sweep flow of liquid is used on the permeate side of the membrane to maintain the concentration gradient driving force. The perstraction process is described in U.S. Pat. No. 4,962,271, herein incorporated by reference.

Figure 4:
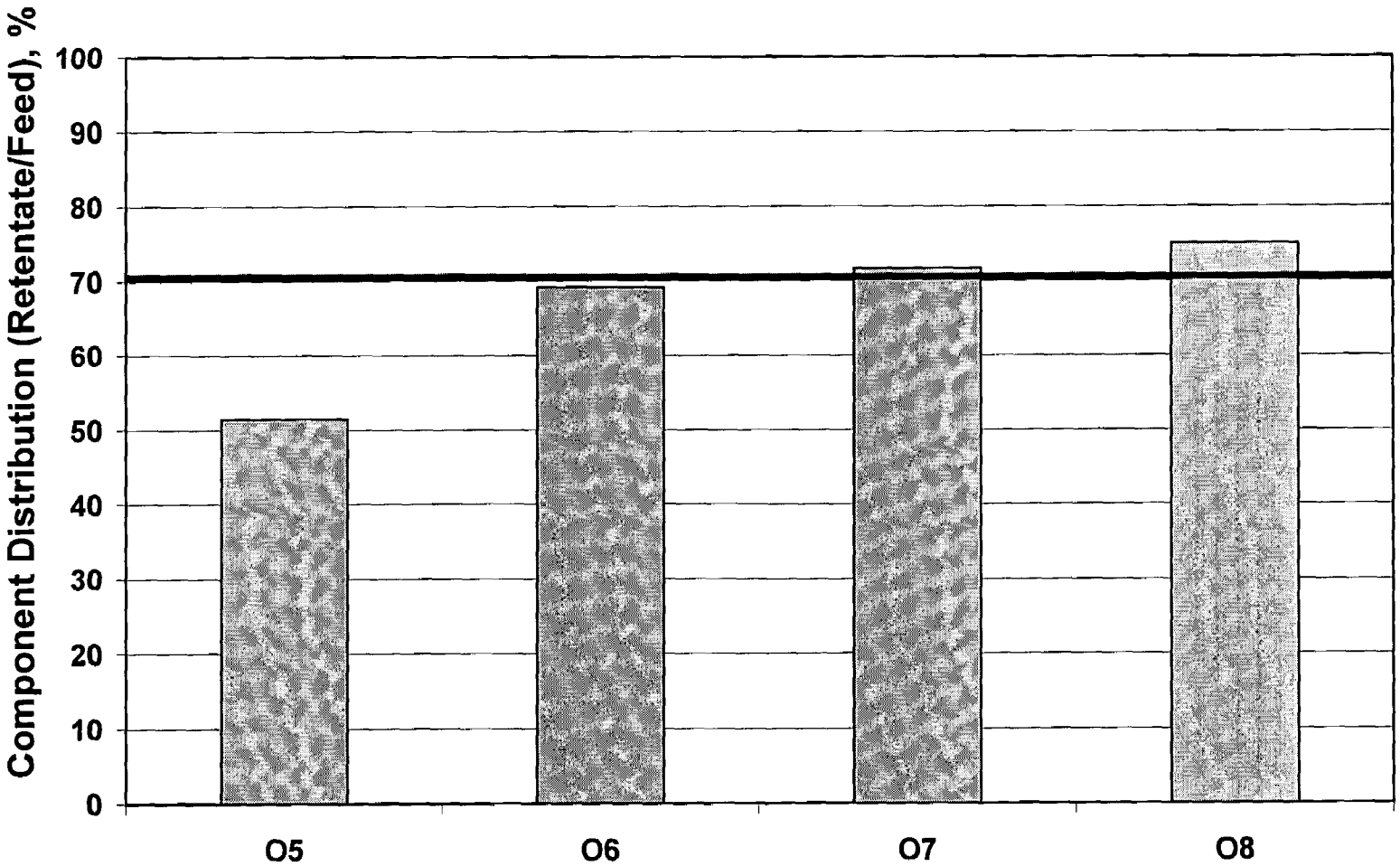
FIG. 4 is a bar graph illustrating olefin content of the membrane retentate generated by a Membrane Separation Zone of the invention.

Very significant reductions in naphtha sulfur content are achievable by the Membrane Separation Zone and, in some cases, sulfur reduction of 90% or better is readily achievable in the retentate while substantially or significantly maintaining the level of olefins initially present in the feed. Typically, the total amount of olefin compounds present in the total Fraction (1) is generally greater than 35 wt %, typically from about 40 to about 60 wt %. As seen in FIG. 4, the membrane used in this invention substantially maintains the naphtha's olefin level.

Sulfur Deficient Retentate and Sulfur Deficient Permeate

The retentate from the membrane is deficient of sulfur relative to the initial Fraction (1) routed from the Fractionation Zone. The composition of the retentate is highly dependent on the feedstock, the type of fractionator or other equipment employed prior to the membrane, the membrane's sulfur enrichment factor and the compounds that are permitted to pass through the membrane. In typical applications, and especially those wherein FCC naphtha is being processed, the sulfur level in the retentate is at least below 70-ppm, and preferably below 50 ppm. In typical applications, however, the retentate is aromatics lean compared to the permeate.

The retentate is further processed and can be blended downstream of the Membrane Separation Zone into gasoline, jet fuel, heavy oil or diesel fuel.

The sulfur enriched permeate, on the other hand, is routed to the Desulfurization Zone, and optionally blended with Fraction (2) of the Fractionation Zone prior to entering the Desulfurization Zone. The sulfur enriched permeate (prior to blending with any other sulfur-containing feed) contains the sulfur species present in Fraction (1). In typical applications, and depending on the type of Fraction (1) membrane, separation process, etc., the permeate will have a sulfur content of around 500-600-ppm.

Desulfurization Zone

The sulfur enriched permeate, and Fraction (2), are contacted with a Desulfurization Zone. The Desulfurization Zone comprises one or more processes conventionally used to reduce and/or remove sulfur from a hydrocarbon feedstock. Conventional processes include, but are not limited to, (1) hydrodesulfirization processes such as used in CDHDS from CDTECH and Scanfining™ process from Exxon Mobil, and (2) sulfur adsorbents such as the S-Zorb™ process from Conoco Phillips. The invention is particularly suitable for the CDHDS process, which is a catalytic distillation hydrodesulfirization process.

Whether employing the CDHDS process, or another conventional hydrodesulfurization process, in the Desulfurization Zone, the sulfur enriched permeate and Fraction (2) are subjected to hydrotreatment, which involves contacting the two with hydrogen over a catalyst. Typical hydrotreating catalysts comprise at least one Group VIII metal and a Group VI metal on an inorganic refractory support, which is preferably alumina or alumina silica. Said Groups are from the Periodic Table of the Elements, such as that found on the last page of Advanced Inorganic Chemistry, $2^{nd}$ Edition 1966, Interscience Publishers, by Cotton and Wilkenson. The Group VIII metal is present in an amount ranging from about 2 to 20 wt %, preferably from about 10 to 40 wt % and more preferably from about 20 to 30 wt %. All metals weight percents are on support. By "on support" it is meant that the percents are based on the weight of the support. For example, if the support were to weigh 100 g. then 20 wt % Group VIII metal would mean that 20 g. of Group VIII metal was on the support.

Any suitable inorganic oxide support material may be used for the catalyst. Preferred are alumina and silica-alumina. More preferred is alumina. The silica content of the silica-alumina support can be from about 2 to 30 wt %, preferably 3 to 20 wt %, more preferably 5 to 19 wt %. Other refractory inorganic compounds may also be used, examples of which include, but are not limited to, zirconia, titania, magnesia, and the like. The alumina can be any of the aluminas conventionally used for hydrotreating catalyst. Such aluminas are generally porous amorphous alumina having an average pore size from about 50 to 200 Å, preferably from about 70 to 150 Å, and a surface area from about 50 to about 450 $m^2/g$ (as measured by BET), preferably from about 100 to 300 $m^2/g$.

As previously stated, hydrotreatment is performed in the presence of hydrogen. Either pure or plant hydrogen may be employed, so long as the stream contains at least about 50% hydrogen.

Hydrotreatment is conducted at a temperature in the range of about 200° to 400° C., preferably about 330 to 400° C., at a pressure in the range of about 250 to 2500 psig, preferably about 300 to 2000 psig, at a hydrogen treat gas rate in the range of about 500 to 8000 SCF/B, preferably about 500 to 6000 SCF/B, at a space velocity in the range 0.2 to 6 LLHSV, preferably 0.3 to 1.0 LHSV.

The effluent from the Desulfurization Zone is reduced in sulfur and nitrogen content and in metals. Hydrotreatment also effects the hydrogenation of olefinic and aromatic unsaturated materials, but in this invention the hydrogenation of olefins is reduced due to more olefins being driven into Fraction (1) of the Fractionation Zone.

When employing a sulfur adsorption process in the Desulfurization Zone, the sulfur enriched permeate and Fraction (2) are combined with a small hydrogen stream and heated to a vaporized stream. The vaporized stream is injected into an expanded fluid-bed reactor, where the sorbent removes sulfur from the feed. A disengaging zone in the reactor removes suspended sorbent from the vapor, which exits the reactor to be cooled. The sorbent is continuously withdrawn from the reactor and transferred to the regenerator section (2), where the sulfur is removed as $SO_2$ and sent to a sulfur-recovery unit. The cleansed sorbent is reconditioned and returned to the reactor. The rate of sorbent circulation is controlled to help maintain the desired sulfur concentration in the product. Sorbents used in these processes are well known and include nickel, alumina and/or zinc oxide-containing catalysts.

The general operating conditions of a sulfur adsorption process follow:

| | |
|---|---|
| Temperature, ° F. | 650–775 |
| Pressure, psig | 100–300 |
| Space velocity, whsv | 4–10 |
| Hydrogen purity, % | 70–99 |
| Total $H_2$ usage, scf/bbl | 40–60 |

The Desulfurization Zone can comprise one or more of the units described above or combination of different desulfurization units. The effluent from the Desulfurization Zone is then further processed and/or blended to form gasoline blend product.

Potential benefits of the invention beyond those mentioned earlier include (but are not limited to):

1. Modular design (expandability and ease of construction)—The Membrane Separation Zone can be modular in nature and readily scaleable compared to, e.g., a CDHDS tower. Equipment for the Membrane Separation Zone can include membrane modules (housing approximately 1000 $m^2$ of membrane surface area per 6 meter long×2 meter diameter shell and tube module), condensers, refrigeration system, vacuum pump and feed pumps. Additional modules can be added with minor piping modifications.

2. Long on-stream time due to ease of maintenance (module replacements)—During operation, banks of modules can be blocked off and module-tubes (one piece) can be pulled and replaced. This will allow for long runs and periodic replacement of membrane to maintain/improve sulfur removal performance.
3. Low operating temperature—Since the process in the Membrane Separation Zone can operate at low temperatures (90-120° C.) fired heaters are not required to heat Fraction (1) to process conditions. This reduces operating costs.
4. No recombination reactions—Since the Membrane Separation Zone does not generate $H_2S$ and it operates at low temperature and pressure, olefins/$H_2S$ recombination reactions do not usually occur.
5. Aromatics (benzene) removal—While not a primary benefit of employing a Membrane Separation Zone, the retentate aromatics level (particularly benzene) is substantially reduced by the process. If lower gasoline benzene specifications are required, the invention presents an opportunity for cost-effectively removing benzene/aromatics, e.g. through the permeate.
6. Retentate is easier to blend downstream—The sulfur deficient retentate from the Membrane Separation Zone is a higher boiling point stream compared to overhead from a CDHydro unit operated under its conventional conditions. Accordingly, when a CDHydro unit is employed as the Fractionation Zone of this invention, the invention drives a Fraction (1) from the unit that has a boiling point greater than 100° C. The boiling point of the effluent from the Membrane Separation Zone is typically the same as that of Fraction (1). Accordingly, the effluent has a lower vapor pressure, thereby making the effluent easier to handle and blend downstream to make a finished gasoline.

EXAMPLES

Example 1

Fraction (1)

An overhead from a CDHydro Unit having a final boiling point of in the range of 100-300° F. was obtained for further separation through a Membrane Separation Zone according to the invention. The content of the overhead had the composition indicated in the Table below.

| CD Hydro Overhead | Composition ppm S |
|---|---|
| Mercaptans | 11.1 |
| Thiophene | 96.2 |
| Methyl Thiophenes | 19.5 |
| Tetrahydro Thiophene | 2.0 |
| C2-Thiophenes | 0.0 |
| Thiophenol | 0.0 |
| C3-Thiophenes | 0.0 |
| Methyl Thiophenol | 0.0 |
| C4-Thiophenes | 0.0 |

-continued

| CD Hydro Overhead | Composition ppm S |
|---|---|
| Unidentified Sulfur Species | 0.0 |
| Benzo Thiophene | 0.0 |
| AlkylBenzo Thiophene | 0.0 |
| Total | 128.8 |

Example 2

Membrane

A polyurea-urethane membrane is prepared as follows.

A polyurea/urethane (PUU) composite membrane is formed through coating of a porous substrate following the methods of U.S. Pat. No. 4,921,611. To a solution of 0.7866 g of toluene diisocyanate terminated polyethylene adipate (Aldrich Chemical Company, Milwaukee, Wis.; Cat. #43, 351-9) in 9.09 g of p-dioxane is added 0.1183 g of 4-4'-methylene dianiline (Aldrich; #13,245-4) dissolved in 3.00 g p-dioxane. When the solution began to gel it is coated with a blade gap set 3.6 mil above a 0.2 micron pore size microporous polytetrafluoroethylene (PTFE) membrane (W. L. Gore, Elkton, Md.). The solvent evaporates to give a continuous film. The composite membrane is then heated in an oven 100° C. for one hour. The final composite membrane structure has a PUU coating 3 microns thick measured by scanning electron microscopy. The membrane shows an enrichment factor of 7.53 for thiophen and 3.15 for mercaptans.

The membrane is then formed into flat sheets for testing purposes.

Example 3

Membrane Separation Zone

Figure 2:
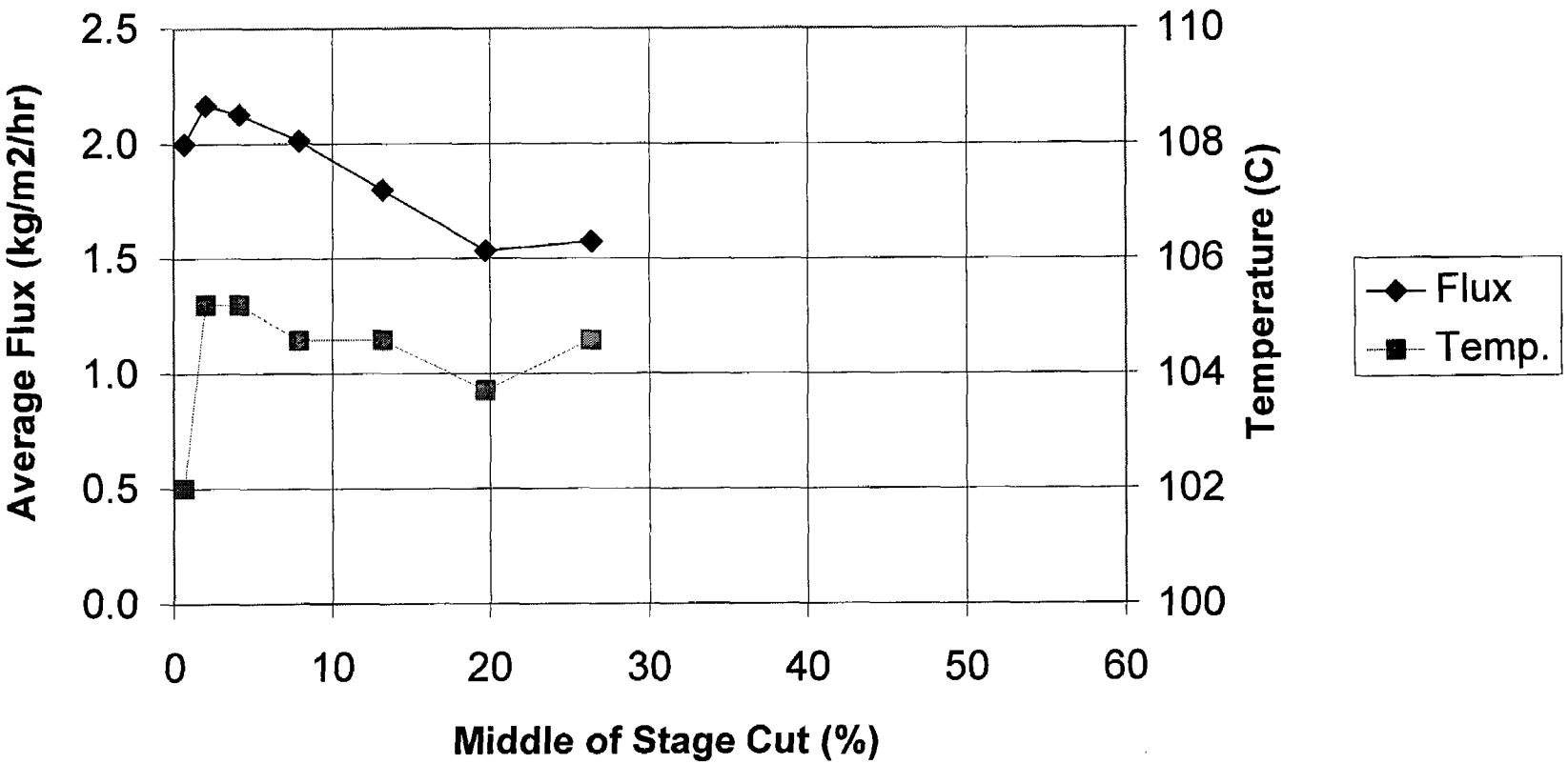
FIG. 2 is a graph illustrating the flux and temperature conditions in a Membrane Separation Zone of this invention that is operating under pervaporation conditions.

The overhead from Example 1 was pumped into a Membrane Separation Zone containing a membrane prepared according to Example 2. The separation was conducted under pervaporation conditions. Specifically, the overhead was pumped at an average flux (kilograms per square meter per hour) and temperature (C.°) illustrated in FIG. 2.

Figure 3:
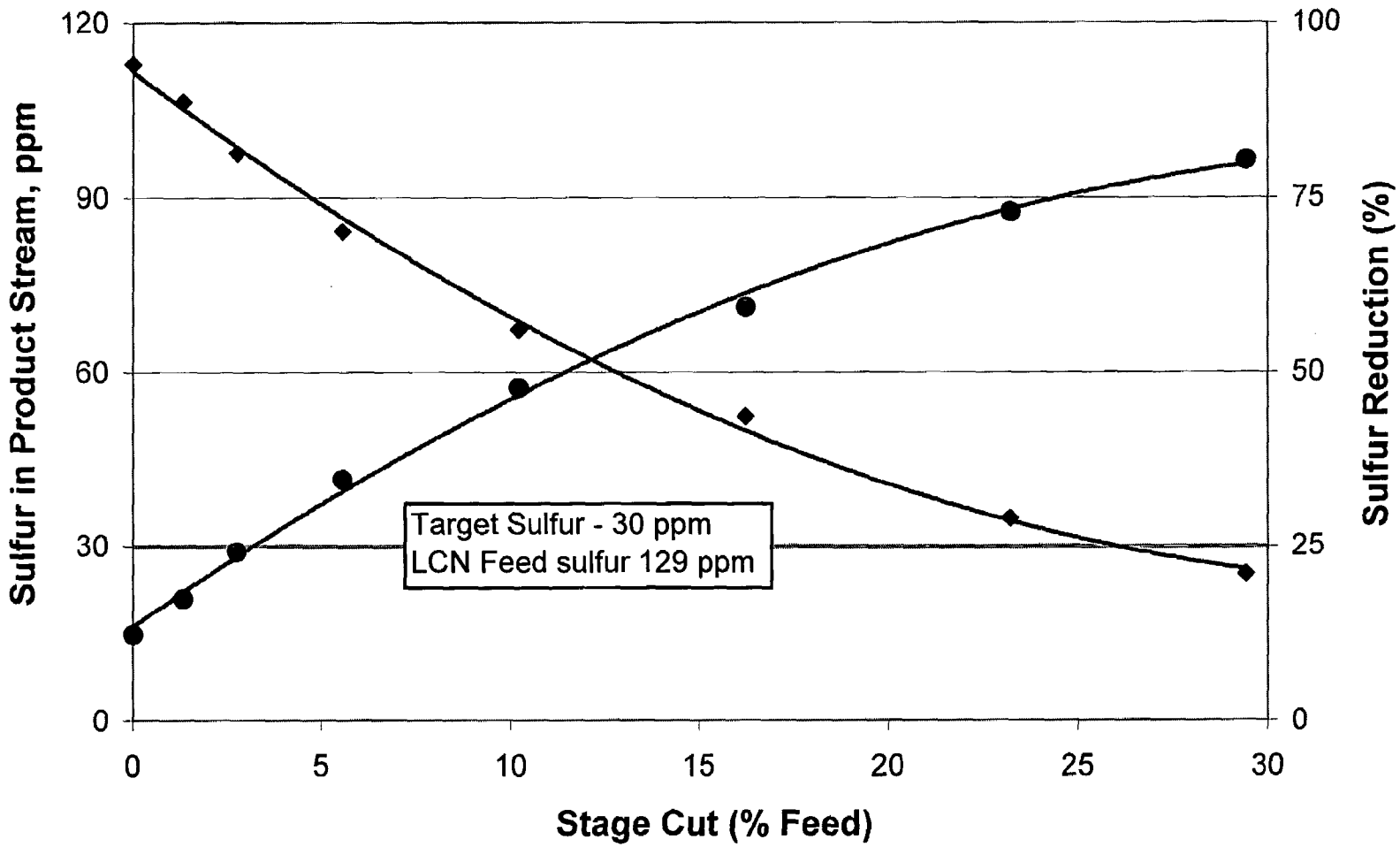
FIG. 3 is a graph illustrating sulfur content in membrane retentate at certain stage cuts and the corresponding sulfur reduction using a Membrane Separation Zone of the invention.

FIG. 3 shows the sulfur content in parts per million (ppm) in the membrane retentate as permeate is collected in amounts based on overhead content. This data is plotted with (♦). FIG. 3 also shows the percentage of sulfur reduction at each plot of sulfur content. Briefly, this graph shows that over 75% sulfur reduction and levels of less than 25 ppm sulfur can be obtained while maintaining at least 70% of the original overhead, thereby leaving 30% of the overhead that has to be routed to the sulfur reduction zone of the invention.

FIG. 4 shows that the olefin distribution of the overhead feed is significantly maintained after a 29.4% stage cut with only some loss shown for $C_5$ olefins (O5). 06, 07 and 08 correspond to $C_6$, $C_7$ and $C_8$ olefin content of the retentate relative to the feed.

It is claimed:

1. A process for reducing sulfur content in a hydrocarbon feedstock containing sulfur, the process comprising:

(a) contacting the hydrocarbon feedstock with a Fractionation Zone to produce under catalytic distillation conditions at least Fraction (1) and Fraction (2), wherein each fraction contains sulfur, and Fraction (1) has a final boiling point that is lower than that of Fraction (2), (b) contacting Fraction (1) with a Membrane Separation Zone, said Membrane Separation Zone containing a membrane having a sufficient flux and selectivity to separate a sulfur-enriched permeate fraction and a sulfur deficient retentate fraction, and said sulfur enriched permeate fraction being enriched in sulfur compared to Fraction (1);

(c) recovering the sulfur deficient retentate fraction;

(d) contacting said sulfur enriched permeate fraction of (b) and said Fraction (2) of (a), separately or as a combination, with a Desulfurization Zone to reduce the sulfur content of the sulfur enriched permeate fraction and Fraction (2); and (e) recovering a hydrocarbon stream from the Desulfurization Zone wherein the hydrocarbon stream has a reduced sulfur content, relative to the sulfur-containing feedstock.

2. A process according to claim 1 wherein the membrane in (b) comprises a member selected from the group consisting of polyimide, polyurea-urethane, polysiloxane and combinations thereof.

3. A process according to claim 1 wherein the membrane in (b) comprises a polyurea-urethane.

4. A process according to claim 1 wherein the hydrocarbon feedstock is a naphtha feed.

5. A process according to claim 4 wherein the naphtha feed contains at least 150 ppm sulfur.

6. A process according to claim 4 wherein the naphtha feed is an effluent from a fluidized catalytic cracking unit.

7. A process according to claim 1 wherein Fraction (1) has a final boiling point in the range of about 50° C. to about 200° C.

8. A process according to claim 1 wherein Fraction (1) has a final boiling point in the range of about 50° C. to about 130° C.

9. A process according to claim 1 wherein Fraction (1) contains sulfur-containing aromatic hydrocarbons.

10. A process according to claim 7 wherein Fraction (1) contains sulfur-containing aromatic hydrocarbons.

11. A process according to claim 4 wherein Fraction (1) contains sulfur-containing aromatic hydrocarbons.

12. A process according to claim 1 wherein Fraction (1) contains sulfur-containing aromatic hydrocarbons.

13. A process according to claim 9 wherein Fraction (1) contains thiophene or alkylthiophene.

14. A process according to claim 10 wherein Fraction (1) contains thiophene or alkylthiophene.

15. A process according to claim 11 wherein Fraction (1) contains thiophene or alkylthiophene.

16. A process according to claim 12 wherein Fraction (1) contains thiophene or alkylthiophene.

17. A process according to claim 16 wherein Fraction (1) is substantially free of mercaptan-containing compound.

18. A process according to claim 1 wherein Fraction (2) contains a member selected from the group consisting of benzothiophene, alkylbenzothiophene, and thioethers.

19. A process according to claim 1 wherein the sulfur deficient retentate fraction of step (b) contains 70 ppm or less sulfur.

20. A process according to claim 1 wherein the Membrane Separation Zone operates under pervaporation conditions.

21. A process according to claim 1 wherein the membrane has a sulfur enrichment factor of at least 1.5.

22. A process according to claim 1 wherein sulfur deficient retentate fraction of (b) is transferred as a gasoline blend stock.

23. A process according to claim 1 wherein the Desulfurization Zone of (d) operates under hydrodesulfurization conditions.

24. A process according to claim 1 wherein the Desulfurization Zone of (d) operates under catalytic hydrodesulfurization conditions.

25. A process according to claim 24 wherein the sulfur content of reduced sulfur-containing hydrocarbon streams from the Desulfurization Zone in (f) is 50 ppm or less sulfur.

* * * * *